United States Patent [19]

Oka et al.

[11] Patent Number: 4,650,070

[45] Date of Patent: Mar. 17, 1987

[54] TONER CARTRIDGE

[75] Inventors: Seiji Oka, Kawasaki; Yoshiharu Morita, Numazu, both of Japan

[73] Assignee: Ricoh Company, Ltd., Tokyo, Japan

[21] Appl. No.: 584,624

[22] Filed: Feb. 29, 1984

[30] Foreign Application Priority Data

Feb. 24, 1984 [JP] Japan ..... 59-32519

[51] Int. Cl.[4] ..... B65D 47/00; B65D 83/06

[52] U.S. Cl. ..... 206/216; 206/633; 220/346; 222/541; 222/DIG. 1

[58] Field of Search ..... 206/216, 525, 633; 220/258, 260, 345, 346; 222/DIG. 1, 541; 430/965

[56] References Cited

U.S. PATENT DOCUMENTS

| | | | |
|---|---|---|---|
| 2,184,227 | 12/1939 | Rueger | 222/541 |
| 3,362,564 | 1/1956 | Mueller | 220/346 |
| 3,388,853 | 6/1968 | Matich, Jr. | 222/DIG. 1 |
| 3,604,616 | 9/1971 | Grief | 206/440 |
| 3,618,826 | 11/1971 | Kangus et al. | 206/633 |
| 3,756,387 | 9/1973 | Chaney | 220/345 |
| 3,999,654 | 12/1976 | Pollack | 206/216 |
| 4,237,943 | 12/1980 | Ermel et al. | 222/DIG. 1 |
| 4,251,001 | 2/1981 | Hipp, Jr. | 206/216 |
| 4,289,250 | 9/1981 | Jordan | 220/260 |
| 4,401,229 | 8/1983 | Bell et al. | 220/258 |
| 4,573,614 | 3/1986 | Ozawa | 222/DIG. 1 |

*Primary Examiner*—William Price
*Assistant Examiner*—Jimmy G. Foster
*Attorney, Agent, or Firm*—Oblon, Fisher, Spivak, McClelland & Maier

[57] ABSTRACT

A toner cartridge for use in replenishing additional toner to a toner storing section of an imaging machine, such as an electrophotographic copier, which uses toner to produce a visible image is provided. The present toner cartridge includes a trough-shaped container having an opening, a cover which is large enough to encompass the opening and supported to be slidably movable with respect to the container between a closed position to close the opening and an open position to open the opening, and a seal member having one end fixed to the container and another end fixed to the cover. Thus, when the cover is moved from the closed position to the open position, the seal member is partly separated away from the container to make the opening half-open. Then, the seal member is pulled to completely open the opening to have the toner completely discharged from the container. Thereafter, the cover is returned to the closed position to close the opening. With such a structure, toner is completely prevented from being scattered.

10 Claims, 22 Drawing Figures

TONER CARTRIDGE

BACKGROUND OF THE INVENTION

1. Field of the Invention

This invention relates to a toner cartridge for supplying toner to various types of imaging machines, such as electrophotographic copiers, which use toner to form visual images, and particularly to a toner cartridge generally including a container which contains therein a quantity of toner and has an opening, a seal member which initially seals the opening of container, and a cover which is movable with respect to the container, whereby movement of the cover causes the seal member to be separated from the opening of the container thereby dumping the toner into a toner storage section.

2. Description of the Prior Art

In various types of imaging machines, such as electrophotographic copiers, which use toner to form visual images, toner must be replenished from time to time because the toner is expended as imaging is carried out repetitively. For example, in a typical copying machine, an electrostatic latent image is first formed on an electrophotographic member and then the latent image is developed by applying toner thereon thereby converting the latent image into a visible toner image, which is then transferred to a transfer medium such as paper, followed by a step of fixing the transferred image to the transfer medium. Accordingly, in a copying machine, a toner storing section is typically provided adjacent to its developing device thereby having the toner supplied to the developing device continuously from the storing section. However, when the toner stored in the toner storing section becomes scarce, fresh toner must be added to the toner storing section in order to maintain a proper developing operation. And, several approaches have been proposed to carry out a toner replenishment operation.

In accordance with one of the proposed approaches, a toner bottle containing therein a quantity of toner is used. In this case, a lid provided on top of the toner storing section is opened and the toner bottle with its cap removed is turned upside down to pour the toner into the toner storing section. This approach is quite simple, but there are great many occasions for toner scattering to take place. For example, toner may be scattered when the lid is opened, when the cap is removed from the bottle, and when the bottle is turned upside down. Scattered toner would not only contaminate the copying machine and its surrounding area but also impair its performance. Moreover, for the operator, his or her hands as well as suits will become dirty and it can be injurious when inhaled deeply. Thus, this approach is quite disadvantageous.

In accordance with another prior art approach, it is proposed to use a cartridge type toner container containing therein a quantity of toner, which may be detachably mounted at the top of a toner storing section and which has its opening initially sealed by a seal member. In accordance with this approach, when mounting the toner cartridge, the seal member must be removed and the cartridge must be set in position for causing the fresh toner to be replenished into the toner storing section. This approach, however, also suffers from the disadvantages of toner scattering similar to the first approach described above. For example, toner scattering takes place most likely when the seal is removed. In addition, the seal is not well protected in many cases so that the seal could be broken unintentionally, for example, during shipping thereby resulting in disastrous toner scattering.

Other prior art approaches also suffer from the similar disadvantages and none of them can solve the problem of toner scattering completely. Moreover, it is important that the toner replenishment operation may be carried out without requiring experiences and special skills because many of copier users are unskilled people and they are often required to replenish toner into the copiers.

SUMMARY OF THE INVENTION

It is therefore a primary object of the present invention to provide an improved toner cartridge.

Another object of the present invention is to provide a toner cartridge which may carry out a toner replenishing operation without causing toner scattering at all.

A further object of the present invention is to provide a toner cartridge which allows to replenish toner with ease thereby requiring no experiences and special skills.

A still further object of the present invention is to provide a toner cartridge which can replenish a significantly large amount of toner easily without causing scattering of toner.

Other objects, advantages and novel features of the present invention will become apparent from the following detailed description of the invention when considered in conjunction with the accompanying drawings.

BRIEF DESCRIPTION OF THE DRAWINGS

FIGS. 6*a* through 6*d* show an example of a container forming part of the present toner cartridge and initially containing therein a quantity of toner to be replenished, wherein FIG. 6*a* is a plan view, FIG. 6*b* is a longitudinal, cross-sectional view taken along line VI—VI indicated in FIG. 6*a*, FIG. 6*c* is a left, side-elevational view and FIG. 6*d* is a right side-elevational view;

FIGS. 7*a* through 7*c* show an example of a cover which forms another part of the present toner cartridge and is slidably movable with respect to the container, in which FIG. 7*a* is a plan view, FIG. 7*b* is a longitudinal, cross-sectional view taken along line VII—VII indicated in FIG. 7*a* and FIG. 7*c* is a left, side-elevational view;

FIG. 9 is a fragmentary, plan view showing on an enlarged scale a front portion of the cover shown in FIG. 7a;

FIG. 10 is a fragmentary, plan view showing on an enlarged scale a side portion of the container shown in FIG. 6a.

DESCRIPTION OF THE PREFERRED EMBODIMENTS

Figure 1:
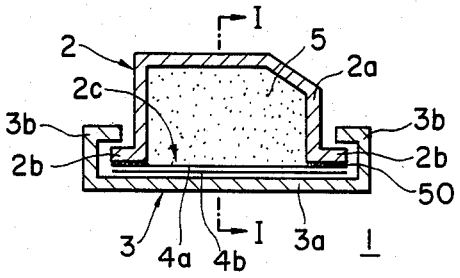
FIG. 1 is a transverse, cross-sectional view showing schematically a toner cartridge constructed in accordance with one embodiment of the present invention.

Referring now to FIGS. 1 and 2, there is schematically shown a toner cartridge 1 constructed in accordance with one embodiment of the present invention. FIG. 1 is a transverse, cross-sectional view and FIG. 2 is a longitudinal, cross-sectional view taken along line I—I indicated in FIG. 1. As shown, the present toner cartridge 1 generally includes a trough-shaped container 2 which is placed as turned upside down, an elongated cover 3 which extends along and is held slidably movably with respect to the container 2 and a seal member 4 which is placed between the container 2 and the cover 3 for sealing the container 2 initially. In the embodiment shown in FIG. 1, the container 2 comprises a trough portion 2a which includes a bottom wall, a pair of side walls, a front wall and a rear wall for defining a storage space generally in the shape of a rectangular receptacle for storing therein a quantity of toner 5. An opening 2c is defined by the top ends of the side, front and rear walls of the container 2. The container 2 also comprises a pair of side projections 2b, 2b extending horizontally outwardly from the ends of the side walls and front and rear projections 2d and 2e ( see FIG. 2a) extending horizontally outwardly from the ends of the front and rear walls, respectively. The container 2 also includes a stopper pin 2f as provided integrally with the front projection 2d, as shown in FIG. 2a. In the preferred embodiment, the container 2 is integrally formed from a plastic material.

The cover 3, on the other hand, includes a flat base portion 3a which is generally rectangular in shape, a pair of side rail portions 3b, 3b formed along the sides of the flat base portion 3a and a front end wall 3c which extends upright from the front end of the base portion 3a. The base portion 3a, side rail portions 3b, 3b and the front end wall 3c are all formed integrally and preferably by a plastic material. As will be explained more in detail later, each of the rail portions 3b, 3b includes a side wall which extends upright from the corresponding side of the base portion 3a and a horizontal projection which extends horizontally inwardly from the top end of the side wall, and, thus, each of the rail portions 3b, 3b defines a receiving space for receiving therein the corresponding side projection 2b of the container 2 so that the cover 3 may be slidingly moved relative to the container 2 as guided by the rail portions 3b, 3b. As will be appreciated later, the cover 3 is elongated and long enough to encompass the opening 2c of the container 2 when placed in a closed position.

The cover 3 also includes a stopper projection 3h provided at the rear end of and projecting inwardly from the rail portion 3b. The stopper projection 3h is engageable with the stopper pin 2f to limit the further relative motion between the container 2 and the cover 3 when the cover 3 is slidingly moved from the closed position to an open position thereby preventing the cover 3 from being completely disengaged from the container 2. Although not shown specifically in these figures, there is also provided a lock mechanism capable of having the cover 3 locked to or unlocked from the container 3, as will be described more in detail later. Front and rear slots 3f and 3d are formed in the cover 3 with their longitudinal axes directed normal to the longitudinal axis of the cover 3 and extending substantially across the width of the cover 3. The cover 3 also includes a fixing member 3g provided at its bottom surface adjacent to the front slot 3f for fixedly attaching one end of the seal member 4 whose the other end is fixedly attached to the bottom surface of front projection 2d of container 2 by means of another fixing member 4d. A wiping ridge 3d is provided on the base portion 3a of cover 3 as extending along the rear slot 3d and it serves to wipe off the toner sticking to the seal member 4 when it is pulled outwardly to open the mouth of container 2.

Figure 2A:
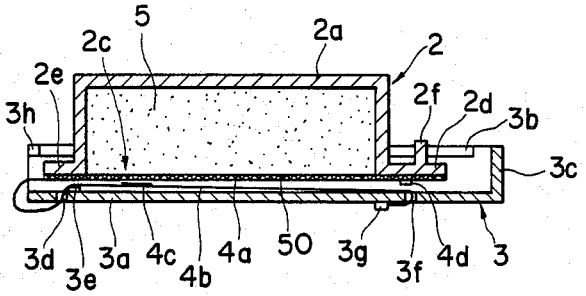
FIGS. 2*a* through 2*e* are longitudinal, cross-sectional views of the toner cartridge shown in FIG. 1 taken along line I—I indicated therein, which are useful for explaining the operation of this embodiment.

The seal member 4 is slightly longer than twice the longitudinal length of the container 2 and it is initially folded back and forth with its top folded half 4a being initially adhesively attached to the projections 2b, 2b, 2f and 2e by an adhesive 50 to sealingly close the opening 2c with its bottom half 4b passed around the rear end of cover 3 and extended through the rear slot 3d onto the top surface of base portion 3a and again through the front slot 3f to the fixing member 3g as described previously. Thus, the seal member top half 4a must be wider than the width of the opening 2c. Besides, the adhesive 50 must be such that the seal member top half 4a may be gradually separated away from the container 2 from its rear end to front end with ease when the cover 3 is slidingly moved away from the container 2. A grip member 4c is provided as fixedly attached to the top surface of the seal member bottom half 4b as shown in FIG. 2a. As will be understood later, the grip member 4c is provided such that it becomes exposed when the cover 3 is moved to its open position and it may be grabbed by an operator to pull the seal member 4 toward the operator to completely open the opening 2c of the container 2.

Referring to FIGS. 2a through 2e, it will now be described as to the operation of the above-described embodiment hereinbelow. FIG. 2a shows the initial condition of the present toner cartridge as shipped from a supplier. As shown, the seal member top half 4a is adhesively attached to the container 2 to sealingly close the opening 2c to have a predetermined amount of toner 5 confined therein. Of importance, the cover 3 is located at its closed position as locked by a locking mechanism not shown) thereby completely covering the seal member top half 4a adhering to the container 2, and, thus, the seal member top half 4a is well prevented from being accidentally peeled off the container 2 during handling for shipment and storage.

In order to carry out a toner replenishment operation using the toner cartridge 1, it must first be detachably mounted at a toner replenishing position defined in an imaging device such as a copier which needs toner to be replenished. As will be made clear later, when the toner cartridge 1 is mounted in position for carrying out a toner replenishing operation, the container 2 is firmly held in a fixed position; whereas, the cover 3 may be slidingly moved with respect to the stationarily held container 2 when a later-described locking mechanism is unlocked. FIG. 2a indicates the initial condition in which the container 2 is fixedly held in a predetermined position which is normally defined above a toner storing section such as a hopper, from which the toner is supplied to a developing device.

Figure 2B:
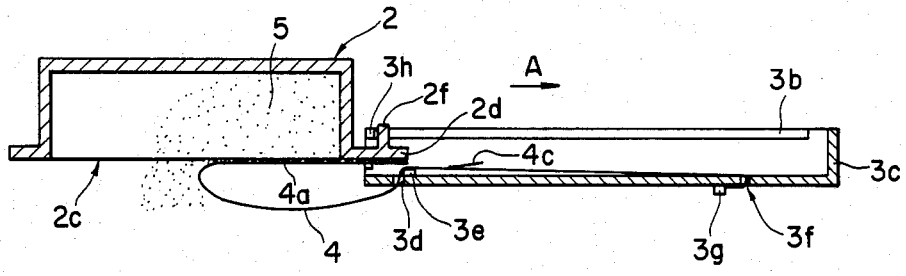

After mounting the toner cartridge 1 at the replenishing position, the cover 3 is slidingly moved away from the container 2 in the direction indicated by the arrow A as shown in FIG. 2*b* until the stopper projection 3*h* comes into engagement with the stopper pin 2*f*, whereby the cover 3 is located at its open position. In this case, the operator grabs the front end wall 3*c* and pulls the cover 3 toward himself. During this process, the mouth 2*c* of container 2 becomes half-open so that the toner 5 so far confined in the container 2 falls into the storage section defined therebelow. It should also be noted that since the seal member 4 is passed around the rear end of the cover 3 in the form of a loop, the seal member 4 is pulled downward substantially perpendicularly with respect to the plane defined by the side, front and rear projections 2*b*, 2*b*, 2*d* and 2*e* thereby allowing the seal member top half 4*a* to be easily peeled off.

Figure 2C:
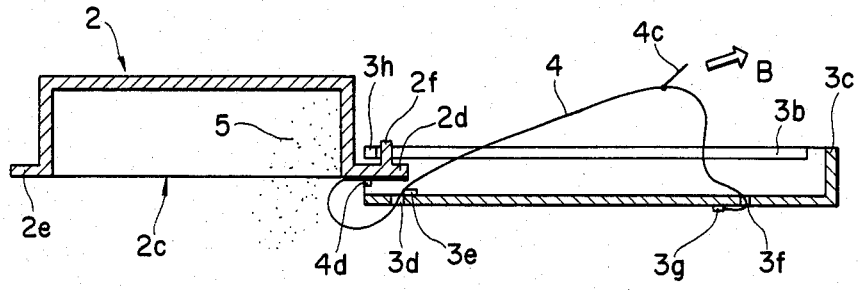

However, the mouth 2*c* is only half-open even when the cover 3 is moved to its open position so that there is still a substantial amount of toner 5 confined in the container 2. Therefore, the operator now grabs the grip member 4*c* which is now exposed since the cover 3 is at the open position and then pulls the seal member 4 toward himself in the direction indicated by the arrow B as shown in FIG. 2*c*. When so pulled, that portion of the seal member top half 4*a* still adhering to the container 2 is peeled off thereby allowing the remaining toner 5 to be discharged and the seal member 4 is pulled onto the top surface of the cover 3 as passing through the rear slot 3*d*. Under this condition, the mouth 2*c* becomes completely open as shown in FIG. 2*c*. During this pulling process, it is also important to note that that surface of the seal member top half 4*a* which has been initially facing the mouth 2*c* is scrubbed against the wiping ridge 3*e* so that the pulled out portion of seal member 4 is free of toner thereby permitting to prevent even a slightest amount of toner from being scattered. Even if the seal member 4 is pulled as described above, the cover 3 maintains its open position owing to the engagement between the stopper pin 2*f* and the stopper projection 3*h*. Furthermore, it is also important to note that the seal member 4 is not completely removed from the toner cartridge 1 because its one end is fixedly attached to the cover 3 by means of the fixing member 3*g* with its the other end fixedly attached to the container front end projection 2*d* by means of the fixing member 4*d*. Such a structure greatly contributes to prevent toner scattering from taking place and enhances easiness in operation.

Figure 2D:
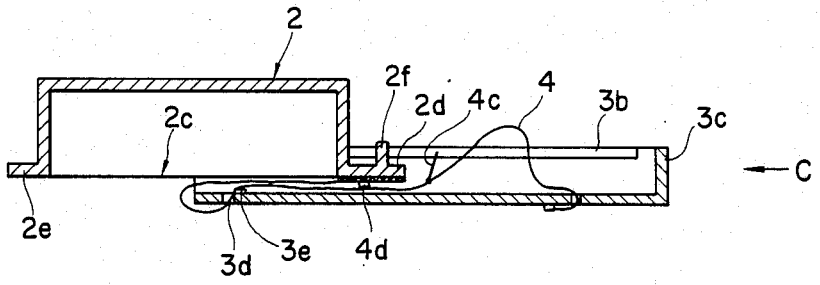
Figure 2E:
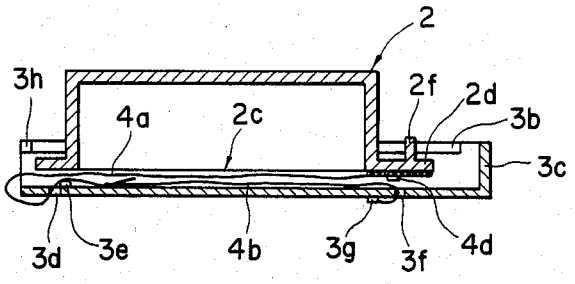

Then, the cover 3 is again slidingly moved with respect to the container 2 but this time in the direction indicated by the arrow C as shown in FIG. 2*d* to the closed position. In this case, the operator simply pushes the cover 3 into the closed position, for example, by grabbing the front end wall 3*c*. FIG. 2*d* shows the condition when the cover 3 is returned halfway to its original closed position. As will be easily understood, the seal member 4 is pulled into the rear slot 3*d* as the cover 3 is slidingly moved to the closed position. FIG. 2*e* shows the condition in which the cover 3 is completely returned to its closed position, which corresponds to the condition shown in FIG. 2*a* excepting that the seal member top half 4*a* is no longer adhered to the container 2. As will become clear later, the cover 3 is pushed back until its movement becomes restrained, under which the cover 3 may be locked to the container 2, whereby no relative movement between the cover 3 and the container 2 takes place. It is to be noted that the cover 3, when located at its closed position as shown in FIG. 2*e*, completely covers the opening 2*c* so that there is no chance of causing toner to be scattered even if the toner cartridge 1 is removed from the imaging machine upon completion of toner replenishing operation.

Figure 3:
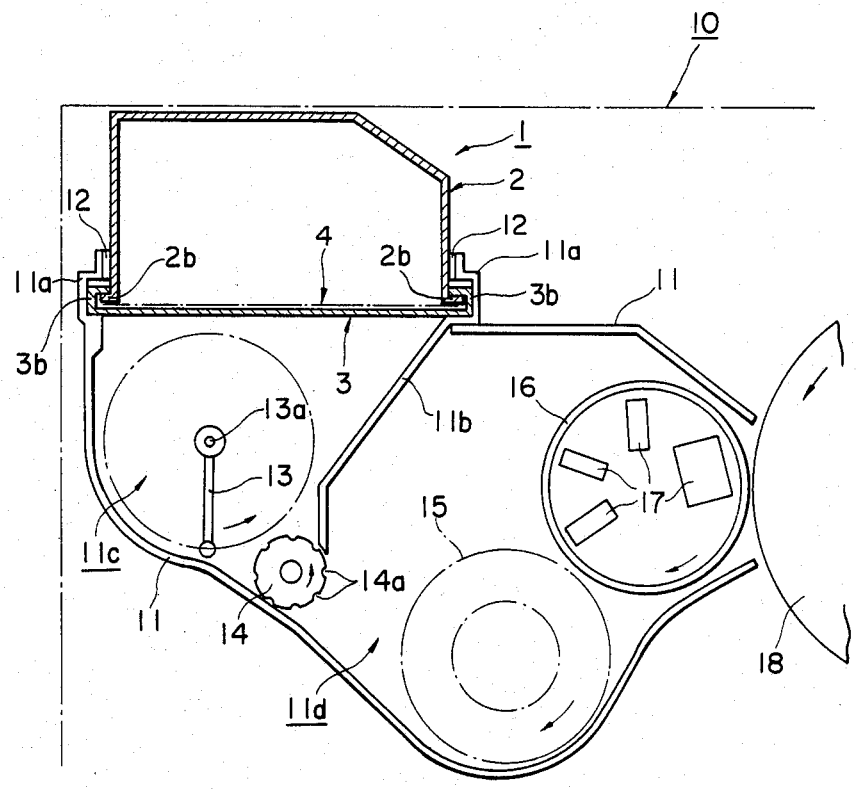
FIG. 3 is a schematic illustration showing an example when the present toner cartridge is applied to an electrophotographic copier.
Figure 4:
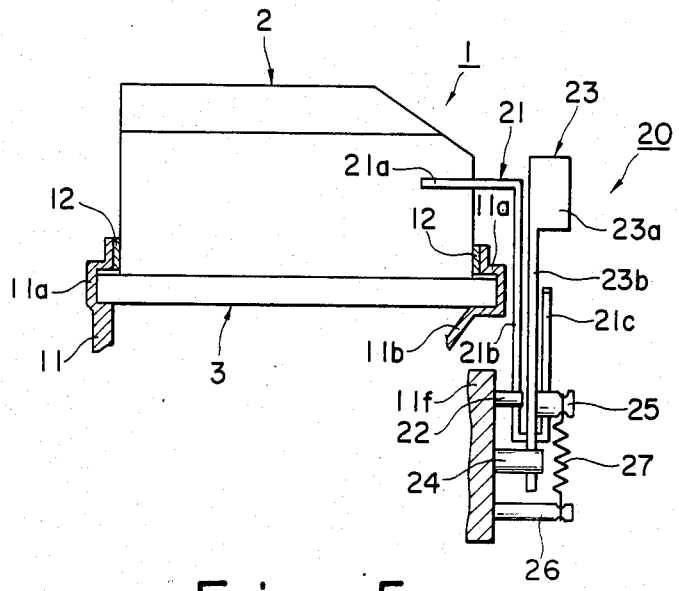
FIGS. 4 and 5 are schematic illustrations showing a holding mechanism provided in the copier of FIG. 3 for keeping the present toner cartridge in position when mounted to carry out a toner replenishment operation.
Figure 5:
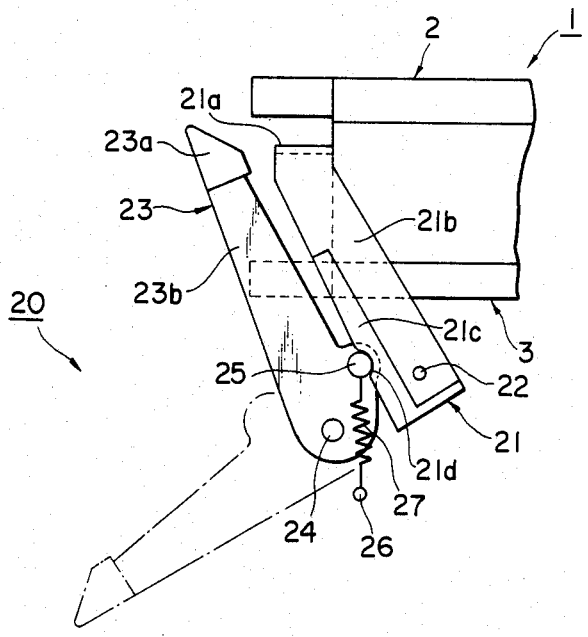

Referring now to FIGS. 3 through 5, an example of clamping the container 2 of the toner cartridge 1 structured as described above at a toner replenishing position defined in an electrophotographic copier will be described. FIG. 3 schematically shows part of such an electrophotographic copier 10 whose contour is generally indicated by the one-dotted line. As shown, the copier 10 includes a housing 11 which generally defines a region of developing station for developing an electrostatic latent image formed on the peripheral surface of a photosensitive drum 18 which is driven to rotate in the direction indicated by the arrow at constant speed. The developing region defined by the housing 11 is divided by a partition wall 11*b* into two compartments: a top left compartment defining a toner storing section 11*c* and a bottom right compartment defining a developing section 11*d*.

At the top of the toner storing section 11*c* is defined a mounting position for detachably mounting the toner cartridge 1 for carrying out a toner replenishment operation. For this purpose, a pair of guide rails 11*a*, 11*a* are formed at the top ends of the housings 11 as extending in parallel in the direction perpendicular to the drawing spaced apart from each other. These guide rails 11*a*, 11*a* are large enough for receiving therein the rail portions 3*b*, 3*b* of the toner cartridge 1, so that when the toner cartridge 1 is to be mounted in position for toner replenishment operation, it is pushed into the replenishing position with its rail portions 3*b*, 3*b* guided by and sliding along the guide rails 11*a*, 11*a*. A sponge seal 12 is fixedly attached to the top end of each of the guide rails 11*a*, 11*a* such that it comes into intimate contact with the side of the toner cartridge 1. Accordingly, toner is prevented from escaping into unwanted interior regions of the copier 10 when the toner is replenished into the toner storing section 11*c* from the cartridge 1.

The toner storing section 11*c* defined below the toner cartridge 1 which is detachably mounted at the toner replenishing position as shown in FIG. 3 includes a rotating lever 13 whose base end is fixedly attached to a rotary shaft 13*a*, so that the toner dumped into the toner storing section 11*c* from the cartridge 1 may be stirred by the rotating lever 13 thereby allowing to prevent the toner from being clumped or aggregated. A supply passage for communication between the toner storing section 11*c* and the developing section 11*d* is defined between the bottom end of the partition wall 11*b* and the housing 11 and a supply control roller 14 is disposed in this supply passage. The supply control roller 14 is provided with a plurality of grooves 14*a* spaced apart at equal angular intervals at its periphery extending in parallel with its rotating axis and driven to rotate in the direction indicated by the arrow. Thus, with the rotation of the supply control roller 14, the toner in the toner storing section 11*c* may be supplied to the developing section 11*d* by a regulated amount.

The developing section 11*d* includes a paddle wheel 15 which is also driven to rotate to transfer the toner supplied from the toner storing section 11*c* to a developing sleeve 16 which is disposed at top right of the paddle wheel 15 in FIG. 3. The developing sleeve 16 is driven to rotate in the direction indicated by the arrow and receives toner from the paddle wheel 15 and forms a thin film of toner charged to a predetermined polarity on its peripheral surface as attracted thereto by magnetic forces produced by a plurality of magnets 17 disposed inside of the sleeve 16. Although not shown specifically in FIG. 3, the developing section 11*d* includes other elements such as a doctor blade for regulating the thickness of the thin film of toner formed on the developing sleeve 16. The toner film formed on the sleeve 16 is brought closer to an electrostatic latent image formed on the photosensitive drum 18 so that the toner is applied selectively to the latent image thereby converting the latent image into a visible toner image. In this manner, the amount of toner stored in the toner storing section 11*c* becomes smaller as more latent images are developed thereby necessitating to replenish additional toner into the toner storing section 11*c* to maintain a proper developing operation.

FIGS. 4 and 5 illustrate how the container 2 of toner cartridge 1 may be clamped at the replenishing position while allowing the cover 3 to be slidably movable with respect to the container 2. FIG. 4 shows the condition in which the toner cartridge 1 is located at the toner replenishing position and it corresponds to the condition shown in FIG. 3. As shown, a clamping mechanism 20 is provided in the copier 10 and it generally includes a pivotally supported clamp lever 21 and a pivotally supported, spring-biased set lever 23. The clamp lever 21 is freely pivotal around a pivot 22 which is fixedly planted in a machine housing 11*f* and it includes a base portion 21*b* extending radially from the pivot 22, a clamp portion 21*a* extending horizontally into a passage way for the cartridge 1 to slidably move along the guide rails 11*a*, 11*a* from the tip end of the base portion 21*b* and an engaging portion 21*c* which is provided with a notch 21*d*. The set lever 23, on the other hand, is freely pivotal around a pivot 24 which is also fixedly planted in the housing 11*f* and it includes a base portion 23*b* extending radially from the pivot 24, a handle 23*a* fixedly mounted at the free end of the base portion 23*b* and an engaging pin 25 fixedly planted in the base portion 23*b*. Also provided is a toggle spring 27 as extended between the engaging pin 25 and a pin 26 fixedly planted in the housing 11*f*.

When desired to mount a toner cartridge 1 at the toner replenishing position by having it slided into the guide rails 11*a*, 11*a*, the operator grabs the handle 23*a* and pivots the set lever 23 counterclockwise to be located at an unclamped position indicated by the one-dotted line. Thanks to the toggle spring 27, the set lever 23 may be maintained at the unclamped position. Such a pivotal motion of the set lever 23 will cause the clamp lever 21 to pivot counterclockwise around the pivot 22 thereby taking a position with the engaging portion 21*c* resting on the pin 25 so that the clamp portion 21*a* is moved away from the passage way for the cartridge 1. Under the condition, the toner cartridge 1 may be pushed into the replenishing position as guided by the guide rails 11*a*, 11*a*. Then, when the set lever 23 is pivotted clockwise to a clamped position indicated by the solid line, the clamp lever 21 is also pivotted clockwise around the pivot 22 until its clamp portion 21*a* comes into contact with the cartridge 1 or a front end surface of container 2. Under the condition, the engaging pin 25 comes into engagement with the notch 21*d* and the clamp lever 21 keeps its clamping position thanks to the biasing force applied by the toggle spring 27. When so clamped, the container 2 may be held in position even if the cover 3 is pulled in the manner described with respect to FIG. 2*b*.

FIGS. 6*a* through 6*d* show in detail one embodiment of a container 32 forming part of the present toner cartridge 1. As shown, the container 32 includes a trough portion 32*a* which is generally in the shape of a rectangular trough defining a storage space for storing therein a quantity of toner and a mouth or opening 32*a*. The container 32 also includes a pair of side projections 32*b*, 32*b*, a front projection 32*d* and a rear projection 32*e*, all of which extend horizontally outwardly from the mouth 32*c* of trough portion 32*a*. The container 32 also includes a front handle 32*f* which may be grabbed by the operator for mounting or dismounting of the cartridge 1. A peripheral ridge 33 is provided partly around the mouth 32*c* and it is used to fixedly attach the seal member 4 thereto by an adhesive. It is to be noted that the peripheral ridge 33 includes a triangular section 33*a* including two ridge portions inclined with respect to the longitudinal axis of the container 32. With the provision of such a triangular section 33*a*, the separation of the seal member 4 from the peripheral ridge 33 may be easily initiated because the seal member 4 is peeled off from the left to the right in FIG. 6*a*.

The container 32 is also provided with an engaging opening 35 at its front projection 32*d* and this forms part of a lock mechanism as will be described more in detail later. Also provided is a pair of stopper protrusions 34, 34 at the corners between the sides and the rear end and they serve to limit the sliding motion of a cover when it is pushed into the closed position. The container 32 also includes a pair of flexible guides 33*b*, 33*b* as part of the peripheral ridge 33 located on both sides of the front projection 32*d*. These flexible guides 33*b*, 33*b* extend slightly beyond the side projections 32*b*, 32*b* and may be brought into sliding contact with the inner wall surfaces of the guide portions of an associated cover, and since these guides 33*b*, 33*b* are flexible, they will insure smooth sliding operation between the container 32 and the associated cover, as will be described more in detail later. A plug 36 is tightly fitted in a hole 36*a* formed in the trough portion 32*a*. And, after pouring a quantity of toner into the container 32, the plug 36 is tightly fitted into the hole 36*a* to keep the toner confined in the container 32. Because of the provision of the triangular ridge 33*a*, there is defined a triangular space 37.

Figure 6A:
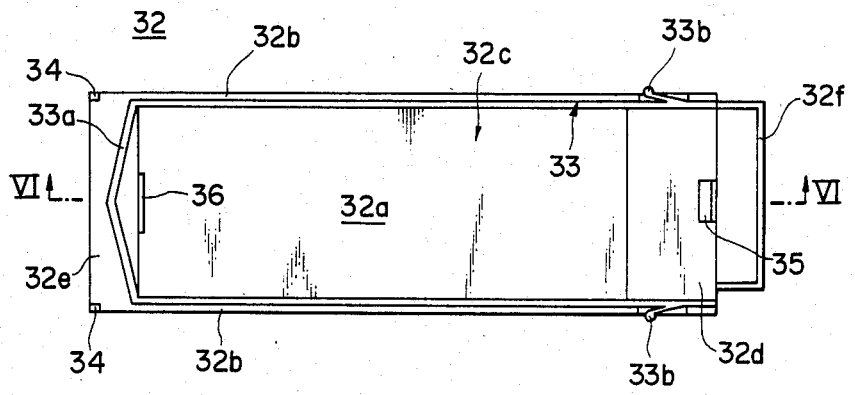
Figure 6B:
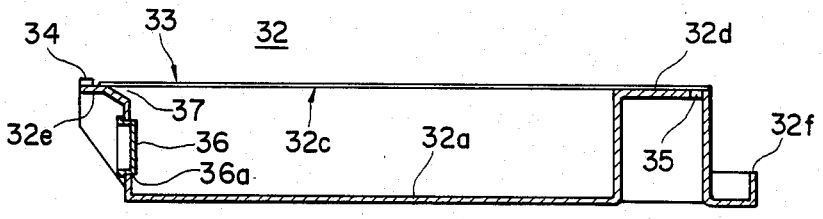
Figure 6C:
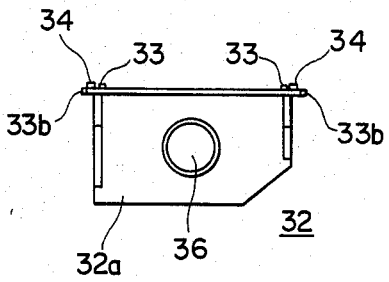
Figure 6D:
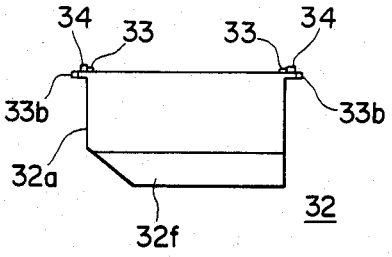
Figure 7A:
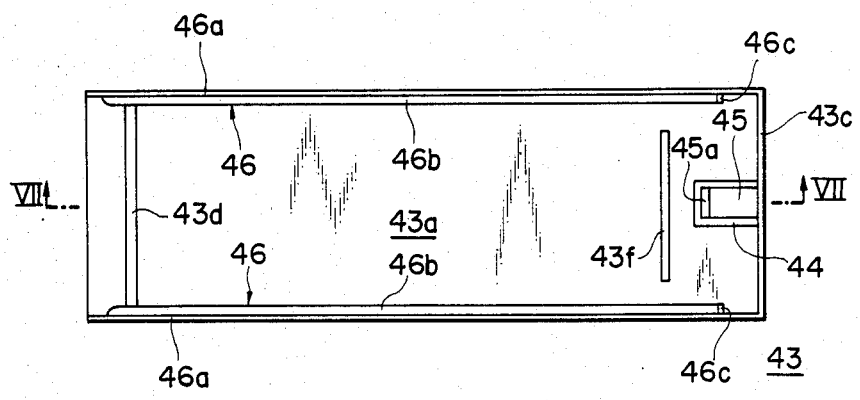
Figure 7B:
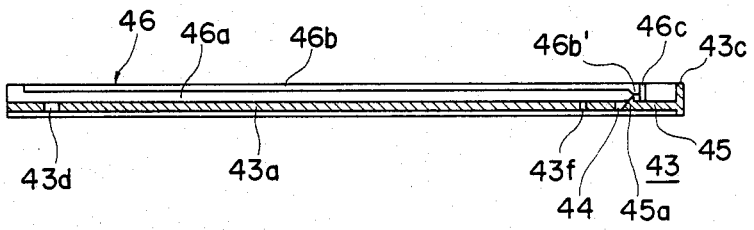
Figure 7C:
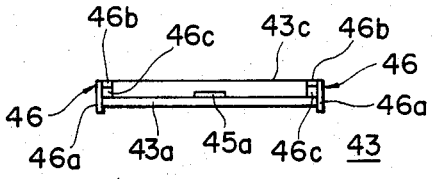

FIGS. 7*a* through 7*c* show a cover 43 which forms part of the present toner cartridge 1 and which may be combined with the container 32 shown in FIGS. 6*a* through 6*d*. The cover 43 includes a flat base portion 43*a* which is generally rectangular in shape and a front end wall 43*c* which also serves as a handle to be grabbed by the operator when moving the cover 43 slidingly with respect to the container 32. The cover 43 also includes a pair of side walls 46*a* which extend upright from the sides of the base portion 43*a* and a pair of horizontal projections 46*b*, 46*b* each extending horizontally inwardly over a predetermined length from the top end of the corresponding side wall 46*a*. Each of the horizontal projections 46*b*, 46*b* includes a downward projection 46*b*′ formed at its front end such that the distance between the base portion 43*a* and the downward projection 46*b*′ is slightly larger than the thickness of the side projection 32*b* of the container 32. Adjacent to the front end of each of the horizontal projections 46*b*, 46*b* is provided a stopper wall 46*c* which may be brought into contact with the front end of the container 2 to limit further relative movement therebetween.

The cover 43 includes front and rear slots 43*d* and 43*f* formed in the base portion 43*a* and the seal member 4 may be set in position as passed through these slots 43*d* and 43*f*, as described previously. There is also formed a shaped slot 44 adjacent to the front end wall 43*c* thereby defining a lock member 45 which is generally rectangular in shape and which may pivotally move owing to its own flexibility. A pawl 45*a* is formed at the free end of the lock member 45. As will be described more in detail later, the pawl 45*a* may be engaged into or disengaged from the engaging hole 35 of the container 32. Thus, basically, the engaging hole 35 and the pawl 45*a* together form a lock mechanism between the container 32 and the cover 43.

Figure 8A:
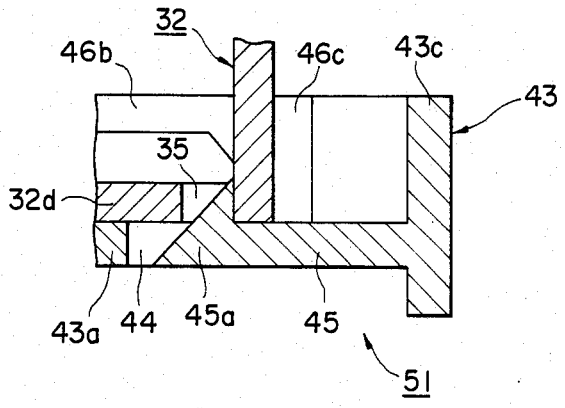
FIGS. 8*a* through 8*c* are schematic views showing on an enlarged scale a locking mechanism provided in the toner cartridge shown in FIGS. 6 and 7 for allowing no relative motion between the container and the cover when locked.
Figure 8B:
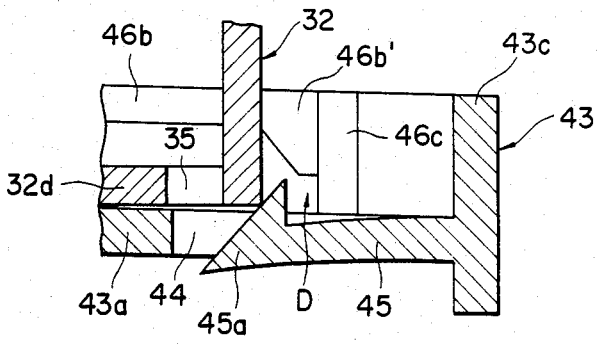
Figure 8C:
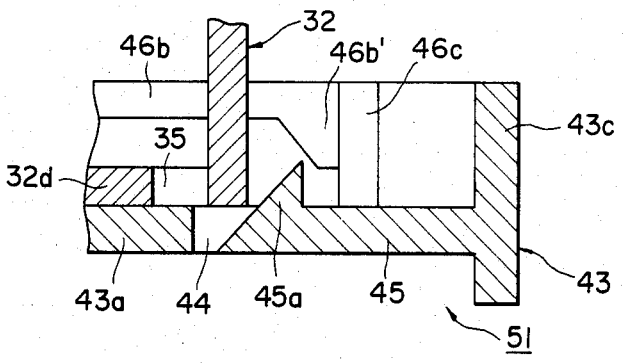

FIGS. 8*a* through 8*c* illustrate a lock mechanism 51 which is generally composed of the lock member 45 having the pawl 45*a* defined at its free end and the engaging hole 35 formed in the front projection 32*d* of the container 32. FIG. 8*a* shows the locked condition in which the pawl 45*a* is fitted into the engaging hole 35. Under this condition, no relative motion between the container 32 and the cover 43 is allowed. The present toner cartridge 1 is normally supplied to a user in the locked condition as illustrated in FIG. 8*a*. In order to carry out a toner replenishing operation, the present toner cartridge 1 is mounted at the toner replenishing position in the locked condition as shown in FIG. 8*a*, and, then, while the lock member 45 is bent downward, for example, by the operator's thumb as shown in FIG. 8*b* to have the pawl 45*a* disengaged from the engaging hole 35, the cover 43 is pulled toward the operator by grabbing the front end wall 43*c*. FIG. 8*c* shows the condition in which the cover 43 is slidingly moved more to the right with respect to the container 32 thereby establishing an unlocked condition. Thereafter, the cover 43 may be slidingly moved further to the right with respect to the stationarily held container 32 to be located at its open position as previously described with reference to FIG. 2*b*. Then, after having the toner 5 completely discharged from the container 32, the cover 43 may be moved to the left to its closed or original position. FIG. 8*c* is the condition in which the pawl 45*a* is about to come into contact with the front end of container 32. If the cover 43 is pushed further to the left, the lock member 45 becomes bent downward due to engagement between the pawl 45*a* and the container 32 and the pawl 45*a* ultimately comes to be fitted into the engaging hole 35, thereby establishing the original locked condition as shown in FIG. 8*a*. Since the locked condition is established, the toner cartridge 1 may be removed from the replenishing position as a unit and there is no chance of causing toner to be scattered.

As briefly described before, since the downward projection 46*b*′ is provided adjacent to the stopper wall 46*c*, the front end of side projection 32*b* which extends sideways from the front end projection 32*d* may be snugly fitted into the space D defined between the downward projection 46*b*′ and the base portion 43*a* as indicated in FIG. 8*b*, thereby allowing to prevent the cover 43 from moving relative to the container 32.

Figure 9:
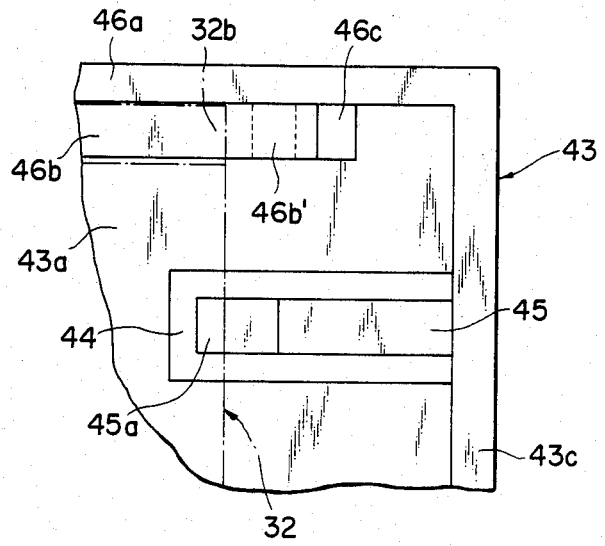

FIG. 9 is a schematic illustration showing on an enlarged scale part of the cover 43 including the lock member 45. The positional relation between the container 32 and the cover 43 shown in FIG. 9 corresponds to the condition shown in FIG. 8*b*.

Figure 10:
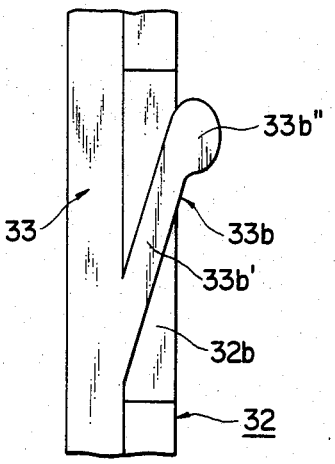
Figure 11:
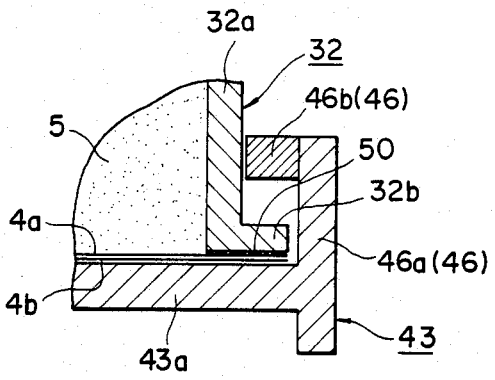
FIG. 11 is a schematic illustration showing on an enlarged scale an engagement between the container and the cover with a folded seal placed therebetween.

FIG. 10 is a schematic illustration showing on an enlarged scale the flexible guide 33*b* formed as a part of the peripheral ridge 33 of the container 32 as briefly described with respect to FIG. 6*a*. As shown, the flexible guide 33*b* includes an arm 33*b*′ extending aslant from the peripheral ridge 33 and a rounded guide portion 33*b*″ formed at the free end of the arm 33*b*′. It is to be noted that the rounded guide portion 33*b*″ normally extends beyond the outer surface of container 32 and thus the outermost point of this rounded guide portion 33*b*″ comes into contact with the inner surface of side wall 46*a*, as may be better understood if reference is also made to FIG. 11. The arm 33*b*′ is so structured that it may bend by its own flexibility. FIG. 11 is a schematic illustration showing on an enlarged scale the engagement between the side projection 32*b* of the container 32 and the guide portion 46, comprised of the side wall 46*a* and the horizontal projection 46*b*, of the cover 43. It is also shown that the seal member top half 4*a* is adhered to the side projection 32*b* by means of the adhesive 50 thereby keeping the toner 5 in the container 32.

While the above provides a full and complete disclosure of the preferred embodiments of the present invention, various modifications, alternate constructions and equivalents may be employed without departing the true spirit and scope of the invention. Therefore, the above description and illustration should not be construed as limiting the scope of the invention, which is defined by the appended claims.

We claim:

1. A toner cartridge comprising:

a container for containing therein a quantity of toner, said container having an opening;

a cover large enough to encompass said opening and slidably movable with respect to said container thereby allowing to move between a closed position to cover said opening and an open position to open said opening;

a seal member having a first end fixed to said container and a second end fixed to said cover, said seal member also having a first portion which is initially adhered to said container to close said opening, whereby said seal member is at least partly separated from said container to at least partly open said opening when said cover is moved to said open position from said closed position; and locking means for locking and unlocking said cover to and from said container.

2. The toner cartridge of claim 1 wherein said container is generally in the shape of a trough which is provided with a pair of side projections extending sideways outwardly from side walls of said trough-shaped container and said cover is provided with a pair of rail portions on both sides thereof each capable of slidably receiving therein the corresponding one of said side projections.

3. The toner cartridge of claim 2 wherein said container is also provided with front and rear projections extending sideways outwardly from front and rear walls of said trough-shaped container and said first portion of said seal member is adhesively adhered to said side, front and rear projections.

4. The toner cartridge of claim 1 wherein said cover is generally rectangular in shape and provided with front and rear slots and said seal member has a second portion which is passed around a rear end of said cover to first pass through said rear slot and then through said front slot thereby having said second end fixedly attached to a bottom of said cover with said first end fixedly attached to said front end of said container, whereby said seal member may be gradually removed from a rear end to a front end of said container as said cover is moved from said closed position to said open position.

5. The toner cartridge of claim 1 wherein said container is provided with a first stopper and said cover is provided with a second stopper which is engageable with said first stopper when said cover is moved to said open position thereby limiting a further relative movement between said container and said cover.

6. The toner cartridge of claim 1 wherein said seal member is provided with a grip which comes to be exposed when said cover is moved to said open position and said first portion of said seal member is separated partly from said container when said cover is moved to said open position with the remaining part of said first portion being separated from said container when said grip is pulled to its extreme.

7. The toner cartridge of claim 5 wherein said cover is also provided with a wiping ridge along said rear slot whereby any toner sticking to said seal member is wiped off as the seal member is pulled outward through said rear slot.

8. The toner cartridge of claim 1 wherein said container is also provided with a hole which may be plugged after pouring said toner into said container.

9. The toner cartridge of claim 1 wherein said container is provided with a peripheral ridge at least partly around said opening and said first portion of said seal member is adhesively attached to said peripheral ridge.

10. The toner cartridge of claim 9 wherein that portion of said peripheral ridge from which said first portion of said seal member is separated when pulled is inclined with respect to a direction for pulling said first portion of said seal member for separation from said peripheral ridge.

* * * * *